United States Patent [19]

Goetzman

[11] 3,975,182

[45] Aug. 17, 1976

[54] PELLETS USEFUL IN SHAFT FURNACE DIRECT REDUCTION AND METHOD OF MAKING SAME

[75] Inventor: Harold E. Goetzman, Grand Rapids, Minn.

[73] Assignee: United States Steel Corporation, Pittsburgh, Pa.

[22] Filed: Aug. 2, 1974

[21] Appl. No.: 494,108

Related U.S. Application Data

[63] Continuation-in-part of Ser. No. 386,893, Aug. 9, 1973, abandoned.

[52] U.S. Cl. ..... 75/3; 75/94

[51] Int. Cl.[2] ..... C22B 1/08; C22B 9/10

[58] Field of Search ..... 75/3, 26, 343, 94, 4, 75/5

[56] References Cited

UNITED STATES PATENTS

| | | | |
|---|---|---|---|
| 2,806,776 | 9/1957 | Veale | 75/5 |
| 3,684,478 | 8/1972 | Fegan | 75/3 |
| 3,748,116 | 7/1973 | Reed | 75/3 |
| 3,849,113 | 11/1974 | Ban | 75/3 |

*Primary Examiner*—Peter D. Rosenberg
*Attorney, Agent, or Firm*—W. L. Krayer

[57] ABSTRACT

Iron ore or concentrates containing about 0.5 to about 3.0% silica, 0.5 to 1.0% bentonite and 96.5 to 99.0% iron oxide together with 7.0 to 12.0% moisture is pelletized, the pellets are surface-coated with about 1 to about 4.5% limestone and fired at a temperature of about 2100° to about 2400°F., the formed pellets being suitable for direct reduction temperatures above 1400°F in a shaft furnace with a minimum of clustering.

19 Claims, No Drawings

PELLETS USEFUL IN SHAFT FURNACE DIRECT REDUCTION AND METHOD OF MAKING SAME

RELATED CASE

This is a continuation-in-part of my copending U.S. patent application Ser. No. 386,893, filed Aug. 9, 1973, and now abandoned, entitled "Method for Improving Flow Characteristics of Iron Oxide Pellets in a Shaft Furnace During Direct Reduction".

BACKGROUND OF THE INVENTION

Prior to the present invention, it has been known to prepare iron ore pellets by mixing iron ore with lime or similar material and pelletizing. Such processes are illustrated and described in the following representative U.S. Pat. Nos. Mayer, 3,393,066; Mayer, 3,615,352; Franklin et al. 3,205,063; O'Conner, 3,214,263; Ban et al. 3,313,617; Mills, 3,351,459; Von Stroh, 3,377,146; Imperato, 3,382,063; Imperato, 3,437,474; Imperato, 3,617,254; and Ishimitsu et al. 3,649,248. The reader may also be interested in Ban, U.S. Pat. No. 3,333,951, which describes forming a dry blend of metal ore including a solid reducing agent such as a carbonaceous material, The dry blend, which is subsequently formed into a pellet, may also include ingredients such as limestone. This dry blend may also be used to coat partially formed pellets.

The reader may also be interested in the various pelletizing and other relevant methods described in the following U.S. Pat. Nos.: Agarwall, 2,871,115; Obst et al., 3,585,025; Price, 3,169,852; Price, 3,188,195; Hanson et al., 3,301,659; Hanson et al., 3,319,949; Ban, 3,264,092; and Anthes et al., 3,326,668.

See also Veale et al., U.S. Pat. Nos. 2,806,776 and 2,806,777 describing methods of strengthening iron ore agglomerates for use in a blast furnace, including certain coating methods leading to the formation of calcium ferrites.

A number of processes for direct reduction of iron ore have been developed in recent years. Among these processes are those in which the desired reduction reactions are carried out in a shaft furnace with a gaseous atmosphere.

The raw material or feed for the shaft furnace can be natural ore but is more often an iron ore concentrate in pelletized form. These pellet feeds can have silica contents of various amounts of which the most desirable are the low-silica variety containing less than 2.5% silica. A large majority of the pellets which could be utilized in the shaft furnaces have the undesirable characteristic of sticking or clustering during reduction at high temperature which makes them unsatisfactory for direct-reduction feed. In particular, the low-silica type pellets seem to show the highest degree of clustering.

In the current state of the art the materials which exhibit clustering characteristics are usually excluded from use in a shaft furnace as they present great difficulty in regulating the material flow through the furnace. When this happens the product is of poor quality, production is reduced and often a furnace will be completely plugged. A reduction under load test to measure the degree of clustering has shown that with low-silica pellets more than 60% of the pellets are often strongly fused together.

One means of improving the pellet flow in a shaft furnace has been to incorporate a rabble arm in the furnace to rotate and break up the clusters as they form. This method, however, is costly and cumbersome to operate without high maintenance.

The objective of this invention is to improve the flow characteristics of the pellets by altering their composition. Pellet feed produced by this method flows uniformly through a shaft furnace without clustering which obviates the need for mechanical devices. It is also quite desirable to provide a direct reduction feed which reacts favorably in all types of shaft furnaces without altering the construction.

DESCRIPTION OF THE INVENTION

The principal object of the invention is to produce pellets from finely ground low-silica iron ore or concentrate that will exhibit low clusterability during high-temperature reduction in a shaft furnace thus facilitating a reduction operation at a higher temperature than would otherwise be possible without adversely affecting burden movement, "burden" being the term used to describe the charge within the furnace. The use of a higher reduction temperature will increase production rate chiefly because reduction gases are more reactive at higher temperatures. It has been discovered that an increase in reduction temperature of 200°F will increase through - put rate by as much as 40% with no increase in gas consumption per ton. The effect on quality of product will depend on the type of material but we have discovered that the use of the materials of the present invention at reduction temperatures as high as 1600°F effectively raised the production rate without increasing material consumption, and it was found that the reduced pellet product exhibited low clusterability together with high reduction and good strength.

The invention is specifically concerned with a method of making iron oxide pellets useful in reducing furnaces. The method includes surface-coating iron oxide pellets having a silica content of about 0.5 to about 2.5%, a bentonite content in the range of about 0.5 to 1.0% and an iron oxide content of about 96.5 to about 99.0% with about 1.0 to about 4.5% of finely powdered limestone, lime or dolomite and indurating the coated pellet by drying at a maximum temperature of 600°F for about six minutes, preheating for a further six minutes at a temperature of about 600° to about 2000°F and firing at a temperature of about 2100° to 2400°F for about 5 to 15 minutes to form a hardened lime-rich surface containing calcium ferrite. Microscopic studies have shown that most of the lime-coating has reacted with the iron oxide to form calcium ferrite.

The problem being dealt with concerns the tendency on the part of pellets formed from low silica ores to form clusters when they are reduced in a shaft furnace at temperatures in excess of 1400°F. Suffice it to say that high silica ores of low basicity can be reduced in pelletized form without undue clustering and with high reduction percentage.

Pellets made from most iron ores or concentrates, particularly from dense hematite or magnetite, show a tendency to form clusters during reduction unless special techniques are used in their preparation. The following factors are of significance in the production of strong, non-clustering highly reducible pellets from hematite ore concentrates, such as derived from Fire Lake specular hematite. The pellets prepared are designed for high temperature reduction, the resultant reduced product being strong and resistant to reoxidation and degradation.

The concentrate to be pelletized is preferably prepared by wet closed circuit grinding to 80 to 95% minus 325 mesh and it exhibits a Blaine index of 1500 to 2100 $cm^2/gm$.

The present invention comprises a method of preparing iron oxide or iron ore pellets suitable for use in a shaft reducer furnace without clustering (clinkering), the finished pellets being prepared by coating (surface-fluxing green pellets) them with a suitable fluxing material and subsequently firing them. The iron ore concentrates used for the pellets are preferably low in silica, having a preferred silica content of 0.5 to 2.5% and they also have about 96.5 to 99.0% iron oxide. It is our practice to incorporate into the ore concentrate from 0.5 to 1.0% bentonite preferably about 0.5% which acts as a binder and to form the concentrate composition into pellets in a balling machine the pellets formed having an average diameter of ¼ to about ¾ of an inch, preferably ⅜ to ⅝ of an inch. The green pellets will also include about 7 to about 12% additional moisture.

The method by which the improved pellets are produced consists of re-rolling or coating them with a powdered lime-bearing material such as limestone, dolomite or hydrated lime, the coating being applied to the pellets immediately after they are formed from the iron oxide concentrate composition. In that form the pellets are commonly referred to as "green balls" or "green pellets" indicating that they have not been indurated. The coating can be applied to the green balls by several different methods, for example by means of a re-roll-ring attached to a balling disc or in a separate balling drum. The lime-bearing material, preferably limestone in the case of the present invention, is metered onto the pellets and with the use of a small amount of spray water becomes attached to the pellet surfaces by means of the well known snow-balling action. The amount of coating varies significantly from 0.5 to 4.5%, the preferred range being 1.0 to 3.0% which in our case gave the best results.

The coated green pellets are next subjected to an indurating process which begins with the drying step which usually lasts for up to six minutes, the temperature used being about 500° to about 700°F, preferably 600°F, and that step is followed by the preheating step which also lasts for up to 6 minutes at a temperature within the range of 1700° to 2000°F, preferably 1900°F, and finally the pellets are fired for up to 15 minutes, usually 5 to 10 minutes, at a firing temperature in the range of about 2100° to 2400°F, preferably 2250° to 2350°F and most preferably 2300°F. Following the firing the pellets are cooled and are ready to be reduced.

During the firing the pellets are consolidated and hardened into a strong iron oxide product which has a lime-rich surface at least some of the lime being in the form of calcium ferrite. It is believed that it is the surface alteration of the pellets that reduces the tendency to cluster during reduction in the presence of a reducing gas in a shaft furnace, the calcium ferrite acting to reduce or prevent the formation of iron-to-iron bonds (welding) during the reduction process.

A further advantage of the invention is that the pellets contain a flux (CaO) which is required in the steel making process in which the reduced pellets will eventually be utilized.

Summing up, 0.5 to 4.5% of finely divided limestone is applied to the surface of unfired iron oxide pellets to produce a surface property during high temperature firing which virtually eliminates sticking of the pellets and improves material flow during subsequent reduction.

The fired pellets showed excellent porosity and exhibited voids in the amount of 20% or higher.

The invention will be illustrated by the following examples which are not to be interpreted in any limiting sense.

EXAMPLE 1

A hematite concentrate containing 1.3% $SiO_2$ was mixed with 0.5% bentonite and pelletized in a balling disc with about 7% moisture to a size of minus ½ plus 7/16 inch. The green balls were then coated in the disc with 2% limestone (49% CaO) ground to a size of minus 65 mesh. A 75-lb. batch of the pellets was charged to a pot-grate apparatus and subject to the following processing conditions:

Drying for 6 minutes — 600°F
Preheating for 6 minutes — 1900°F
Firing for 15 minutes — 2250°F
Cooling to 400°F The resultant pellets gave the following chemical analysis: 68.1% Fe, 1.6% $SiO_2$ and 0.7% CaO. Measurement of the physical properties of the pellets resulted in a tumble index (−28M) of 2.5% and an average compression strength of 950 lb.

Examples 2 to 5 followed the method described in Example 1, the concentrate in each case being hematite.

EXAMPLES 2 to 5

Examples 2 to 5

| Example No. | Silica % | Bentonite % | Moisture % | Limestone % | Basicity |
|---|---|---|---|---|---|
| 2 | 1.2 | 0.5 | 7.0 – 12.0 | 2.0 | 0.4 |
| 3 | 1.9 | 0.5 | 7.0 – 12.0 | 3.3 | 1.0 |
| 4 | 1.5 | 0.5 | 7.0 – 12.0 | 1.0 | 0.3 |
| 5 | 2.3 | 0.5 | 7.0 – 12.0 | 2.0 | 0.6 |

Subsequent reduction under load tests were conducted with these pellets in a bench-scale furnace at 1450°F (1061°K), feed gas composition of 53% $H_2$, 42% CO, and 5% $CO_2$ and $H_2O$, and under a varying applied load of up to 20 psi (15,151 $kg/m^2$). The duration of the reduction tests was 6 hours with an applied load of 10 to 20 psi during the final 4 hours. In addition, reduction under load tests were also conducted at 1600°F (1144°K), a feed gas composition of 63% $H_2$, 23% CO, 2% $CO_2$, and 7% $H_2O$, and under a varying load of up to 10 psi (7,576 $kg/m^2$). Reduced pellets from these tests flowed freely out of the furnace showing zero percent clustering and were highly reduced (95 to 98% reduction).

In comparison, when using pellets produced from the same concentrate without the limestone coating the amount of clustering was 69%. The degree of reduction was about the same as the coated pellets at 97%.

My invention is not limited to the above specific examples and illustrations. It may be otherwise variously practiced within the scope of the following claims.

I claim:

1. Method of making iron oxide pellets which will not form clusters in a vertical shaft moving bed countercurrent reducing furnace comprising:

a. preparing green pellets of ¼ to ¾ inches average diameter from an iron oxide containing composition selected from the group consisting of iron ore and iron ore concentrate having a composition of about 0.5 to about 3.0% silica, 7–12% moisture, and 96.5 to 99% iron oxide, and about 0.5% to about 1.0% bentonite as a binder, b. forming a surface coating thereon of about 1% to about 4.5% of a material selected from the group consisting of lime, limestone and dolomite, c. drying the pellets from about two to about six minutes at 500°F to 700°F, d. in preparation for firing, preheating the pellets at about 1700°F to 2000°F, and e. firing the pellets for about 5 to 15 minutes at a temperature of about 2100°F to 2400°F to form a hard surface containing calcium ferrite.

2. The method according to claim 1 the average diameter of the pellets being ⅜ to ⅝ inches.

3. The method claimed in claim 1, the bentonite content of the pellets being about 0.5%.

4. The method claimed in claim 1, the amount of limestone being about 1.0 to 3.0%.

5. The method claimed in claim 1, the indurating treatment comprising drying for up to 6 minutes at 600°F, preheating for approximately 6 minutes at 1900°F, and firing for 5 to 15 minutes at 2250° to 2350°F.

6. The method claimed in claim 1, the hardened coating containing calcium ferrite or magnesium ferrite.

7. The method of making iron oxide pellets useful in shaft reducer furnaces comprising preparing from finely ground, low silica hematite concentrate including about 7–12% moisture, pellets having an average diameter of about ⅜ to about ⅝ inches, by adding to the concentrates about 0.5 to about 1.5% bentonite and forming pellets in a balling machine, surface-coating the pellets thus formed with about 1 to about 4.5% of a material selected from the group consisting of lime, limestone, and dolomite, and indurating the pellets by drying for a period of about two to about 6 minutes at 50020 to 700°F, preheating for approximately 6 minutes at 1700° to 2000°F and firing for 5 to 15 minutes at 2100° to 2400°F thereby forming a hard coating containing calcium or magnesium ferrite.

8. The method claimed in claim 7 the firing temperature being in the range of 2250° to 2350°F.

9. The method according to claim 7 the average diameter of the pellets being ⅜ to ⅝ inches.

10. The method claimed in claim 7, the bentonite content of the pellets being about 0.5%.

11. The method claimed in claim 7, the amount of limestone being about 1.0 to 3.0%.

12. The method claimed in claim 7, the indurating treatment comprising drying for up to 6 minutes at 600°F, preheating for approximately 6 minutes at 1900°F, and firing for 5 to 15 minutes at 2250° 2350°F.

13. Iron oxide pellets for use in reducing furnaces, the said pellets having a surface coating of 1.0 to 4.5% limestone and having an average diameter of ¼ to ¾ inches, the pellets comprising finely-ground low-silica hematite concentrate having incorporated therein 0.5 to 1.0% bentonite as a binder, and having a hardened coating as a result of firing at 2100° to 2400°F for a period of 5 to 15 minutes.

14. The pellets claimed in claim 13, the average diameter being about ⅜ to about ⅝ inches.

15. The pellets claimed in claim 13, the bentonite content being 0.5%.

16. The pellets claimed in claim 13, the amount of limestone being 1.0 to 3.5%.

17. The pellets claimed in claim 13, the firing temperature being 2250° to 2350°F.

18. The pellets claimed in claim 13, the coating containing calcium ferrite.

19. The pellets claimed in claim 17, the firing temperature being 2300°F.

* * * * *

UNITED STATES PATENT OFFICE

CERTIFICATE OF CORRECTION

Patent No. 3,975,182 Dated August 17, 1976

Inventor(s) Harold E. Goetzman

It is certified that error appears in the above-identified patent and that said Letters Patent are hereby corrected as shown below:

Column 6, line 7, "50020" should read -- 500° --.

Signed and Sealed this

Nineteenth Day of October 1976

[SEAL]

*Attest:*

RUTH C. MASON
*Attesting Officer*

C. MARSHALL DANN
*Commissioner of Patents and Trademarks*